US007207692B1

(12) United States Patent
Hulse

(10) Patent No.: US 7,207,692 B1
(45) Date of Patent: Apr. 24, 2007

(54) ILLUMINATION DEVICE WITH COLOR CONVERSION MODULES

(75) Inventor: George R. Hulse, Cookeville, TN (US)

(73) Assignee: iLight Technologies, Inc., Chicago, IL (US)

( * ) Notice: Subject to any disclaimer, the term of this patent is extended or adjusted under 35 U.S.C. 154(b) by 218 days.

(21) Appl. No.: 11/026,578

(22) Filed: Dec. 30, 2004

Related U.S. Application Data

(63) Continuation-in-part of application No. 10/455,639, filed on Jun. 5, 2003, now Pat. No. 7,011,421, which is a continuation-in-part of application No. 09/982, 705, filed on Oct. 18, 2001, now Pat. No. 6,592,238.

(60) Provisional application No. 60/533,782, filed on Dec. 31, 2003.

(51) Int. Cl.
*F21V 9/00* (2006.01)

(52) U.S. Cl. ..... 362/231; 362/230; 362/235; 362/246

(58) Field of Classification Search ..... 362/231, 362/293, 235, 246, 355, 230, 311, 800, 612, 362/613, 605
See application file for complete search history.

(56) References Cited

U.S. PATENT DOCUMENTS

| | | | | |
|---|---|---|---|---|
| 6,350,041 | B1 * | 2/2002 | Tarsa et al. | 362/231 |
| 6,361,186 | B1 * | 3/2002 | Slayden | 362/249 |
| 6,592,238 | B2 | 7/2003 | Cleaver et al. | |
| 6,761,472 | B1 | 7/2004 | Cleaver et al. | |
| 6,834,979 | B1 | 12/2004 | Cleaver et al. | |

* cited by examiner

*Primary Examiner*—Jong Suk Lee
*Assistant Examiner*—Jacob Y. Choi
(74) *Attorney, Agent, or Firm*—Stites & Harbison, PLLC; David W. Nagle, Jr.

(57) ABSTRACT

An illumination device for simulating neon or similar lighting incorporates removable and interchangeable color conversion modules, thus allowing for emission of light in colors that cannot ordinarily be achieved by use of light-emitting diodes alone without significant increase in cost or complexity of the illumination device.

19 Claims, 4 Drawing Sheets

ILLUMINATION DEVICE WITH COLOR CONVERSION MODULES

CROSS-REFERENCE TO RELATED APPLICATIONS

The present application claims priority to U.S. Provisional Application Ser. No. 60/533,782 filed Dec. 31, 2003 now U.S. Pat. No. 7,011,421, the entire disclosure of which is incorporated herein by reference. The present application is also a continuation-in-part of U.S. Utility application Ser. No. 10/455,639 filed Jun. 5, 2003, which itself is a continuation-in-part of U.S. Utility application Ser. No. 09/982,705 filed Oct. 18, 2001 (now U.S. Pat. No. 6,592,238), the entire disclosures of which are also incorporated herein by reference.

BACKGROUND OF THE INVENTION

The present invention is an illumination device for simulating neon or similar lighting and incorporating removeable and interchangeable color conversion modules, thus allowing for emission of light in colors that cannot ordinarily be achieved by use of LEDs alone without significant increase in cost or complexity of the illumination device.

Neon lighting, which is produced by the electrical stimulation of the electrons in the low-pressure neon gas-filled glass tube, has been a main stay in advertising and for outlining channel letters and building structures for many years. A characteristic of neon lighting is that the tubing encompassing the gas has an even glow over its entire length irrespective of the viewing angle. This characteristic makes neon lighting adaptable for many advertising applications, including script writing and designs, because the glass tubing can be fabricated into curved and twisted configurations simulating script writing and intricate designs. The even glow of neon lighting being typically devoid of hot spots allows for advertising without visual and unsightly distractions. Thus, any illumination device that is developed to duplicate the effects of neon lighting must also have even light distribution over its length and about its circumference. Equally important, such lighting devices must have a brightness that is at least comparable to neon lighting. Further, since neon lighting is a well-established industry, a competitive lighting device must be lightweight and have superior "handleability" characteristics in order to make inroads into the neon lighting market. Neon lighting is recognized as being fragile in nature. Because of the fragility and heavy weight, primarily due to its supporting infrastructure, neon lighting is expensive to package and ship. Moreover, it is extremely awkward to initially handle, install, and/or replace. Any lighting device that can provide those previously enumerated positive characteristics of neon lighting, while minimizing its size, weight, and handleability shortcomings, will provide for a significant advance in the lighting technology.

The recent introduction of lightweight and breakage resistant point light sources, as exemplified by high-intensity light-emitting diodes (LEDs), have shown great promise to those interested in illumination devices that may simulate neon or similar lighting and have stimulated much effort in that direction. However, the twin attributes of neon lighting, uniformity and brightness, have proven to be difficult obstacles to overcome as such attempts to simulate neon lighting have largely been stymied by the tradeoffs between light distribution to promote the uniformity and brightness.

In an attempt to address some of the shortcomings of neon, commonly assigned U.S. Pat. No. 6,592,238, which is incorporated in its entirety herein by reference, describes an illumination device comprising a profiled rod of material having waveguide properties that preferentially scatters light entering one lateral surface ("light-receiving surface") so that the resulting light intensity pattern emitted by another lateral surface of the rod ("light-emitting surface") is elongated along the length of the rod. A light source extends along and is positioned adjacent the light-receiving surface and spaced from the light-emitting surface a distance sufficient to create an elongated light intensity pattern with a major axis along the length of the rod and a minor axis that has a width that covers substantially the entire circumferential width of the light-emitting surface. In a preferred arrangement, the light source is a string of point light sources spaced a distance apart sufficient to permit the mapping of the light emitted by each point light source into the rod so as to create elongated and overlapping light intensity patterns along the light-emitting surface and circumferentially about the surface so that the collective light intensity pattern is perceived as being uniform over the entire light-emitting surface.

One of the essential features of the illumination device described and claimed in U.S. Pat. No. 6,592,238 is the uniformity and intensity of the light emitted by the illumination device. While it is important that the disadvantages of neon lighting be avoided (for example, weight and fragility), an illumination device would have little commercial or practical value if the proper light uniformity and intensity could not be obtained. This objective is achieved primarily through the use of a "leaky" waveguide rod. A "leaky" waveguide is structural member that functions both as an optical waveguide and light scattering member. As a waveguide, it tends to preferentially direct light entering the waveguide, including the light entering a lateral surface thereof, along the axial direction of the waveguide, while as a light scattering member, it urges the light out of an opposite lateral surface of the waveguide. As a result, what is visually perceived is an elongated light pattern being emitted along the light-emitting lateral surface of the waveguide.

Nevertheless, a problem with illumination devices using leaky waveguides and LEDs, as described and claimed in U.S. Pat. No. 6,592,238, is that the available visible color spectrum is limited by the finite availability of LED colors.

Therefore, in commonly assigned and co-pending U.S. patent application Ser. No. 10/455,639 (U.S. Publication No. 2003/0198049), an application which is also incorporated in its entirety herein by reference, an illumination device is described that uses fluorescent dyes, thus allowing for emission of light in colors that cannot ordinarily be achieved by use of LEDs alone without significant increase in cost or complexity of the illumination device. Specifically, the illumination device is generally comprised of a rod-like member, a housing, and a light source. In one preferred embodiment, the rod-like member is a waveguide that has an external curved lateral surface serving as a light-emitting surface and an interior lateral surface that serves as a light-receiving surface, such that light entering the waveguide from the light source positioned below the light-receiving surface is scattered within the waveguide so as to exit with diffused distribution out of the curved lateral surface. The housing preferably comprises a pair of side walls that define an open-ended channel that extends substantially the length of the waveguide. The housing generally functions to house the light source and associated electrical accessories, and also preferably serves to collect and reflect light.

Although it is contemplated that various types of light sources could be incorporated into the illumination device described in U.S. patent application Ser. No. 10/455,639, a string or strings of contiguously mounted high-intensity light-emitting diodes (LEDs) is a preferred light source. However, since the available visible color spectrum of an illumination device; incorporating LEDs as the light source is limited by the finite availability of LED colors, the illumination device is constructed so as to provide for emission of light with a perceived color that is different than that of the LED itself. Specifically, this is accomplished through the incorporation of a light color conversion system into the illumination device, specifically an intermediate light-transmitting medium extending along and positioned adjacent the light source. This intermediate light-transmitting medium is preferably composed of a substantially translucent polyurethane or similar material tinted with a predetermined combination of one or more fluorescent dyes. Because of the position of the intermediate light-transmitting medium adjacent the light source, light emitted from the light source is directed into the intermediate light-transmitting medium and interacts with the fluorescent dyes contained therein. This light is partially absorbed by each of the fluorescent dyes of the intermediate light-transmitting medium, and a lower-energy light is then emitted from each of the fluorescent dyes and into the light-receiving surface of the waveguide. Thus, through selection of appropriate combinations of dyes and varying the density of the dyes within the intermediate light-transmitting medium, colors across the visible spectrum can be produced, colors that are ultimately observed along the light-emitting surface of the waveguide.

It is a paramount object of the present invention to provide an illumination device similar to that described in U.S. patent application Ser. No. 10/455,639, but further allows the illumination device to be configured to generate light of various colors through the use of removable and interchangeable color conversion modules, which may be tinted with one or more fluorescent dyes, phosphorescent dyes, and/or other dyes or colorants.

This and other objects and advantages of the present invention will become readily apparent and addressed through a reading of the discussion below and appended drawings.

SUMMARY OF THE INVENTION

The present invention is an illumination device for simulating neon or similar lighting and incorporating removable and interchangeable color conversion modules, thus allowing for emission of light in colors that cannot ordinarily be achieved by use of LEDs alone without significant increase in cost or complexity of the illumination device.

An exemplary illumination device made in accordance with the present invention is generally comprised of a waveguide or similar diffusing member, a housing, and a light source. Light entering the waveguide or similar diffusing member is scattered so as to exit with diffused distribution. The housing is positioned substantially adjacent the waveguide and generally functions to house the light source and associated electrical accessories (e.g., a circuit board). Although it is contemplated that various types of light sources could be incorporated into the illumination device of the present invention, applicant has determined that the best available light source for the purposes of this invention is a string or strings of contiguously mounted high-intensity light-emitting diodes (LEDs). However, as mentioned above, the available visible color spectrum of an illumination device incorporating LEDs as the light source is limited by the finite availability of LED colors. Therefore, a light color conversion system is incorporated into the illumination device, extending along and positioned adjacent the light source with a light-receiving surface for receiving light emitted from said light source and a light-emitting surface for emitting light into the waveguide. In accordance with the teachings of the present invention, the light color conversion system is comprised of one or more removable and interchangeable color conversion modules positioned within the open-ended channel defined by the housing and interposed between the light source and the waveguide.

Each color conversion module is preferably composed of a substantially translucent polyurethane, acrylic, or similar material tinted with a predetermined combination of one or more fluorescent dyes, phosphorescent dyes, and/or other dyes or colorants. Although a color conversion module can be configured in various geometries, it must have a shape that allows it to be inserted into the channel defined by the housing between the waveguide and the light source. Thus, after passing through the one or more color conversion modules, light emitted from the waveguide of the illumination device has a perceived color (or hue) that is different than that of the light source.

DETAILED DESCRIPTION OF THE INVENTION

The present invention is an illumination device for simulating neon or similar lighting and incorporating removable and interchangeable color conversion modules, thus allowing for emission of light in colors that cannot ordinarily be achieved by use of LEDs alone without significant increase in cost or complexity of the illumination device.

Figure 1:
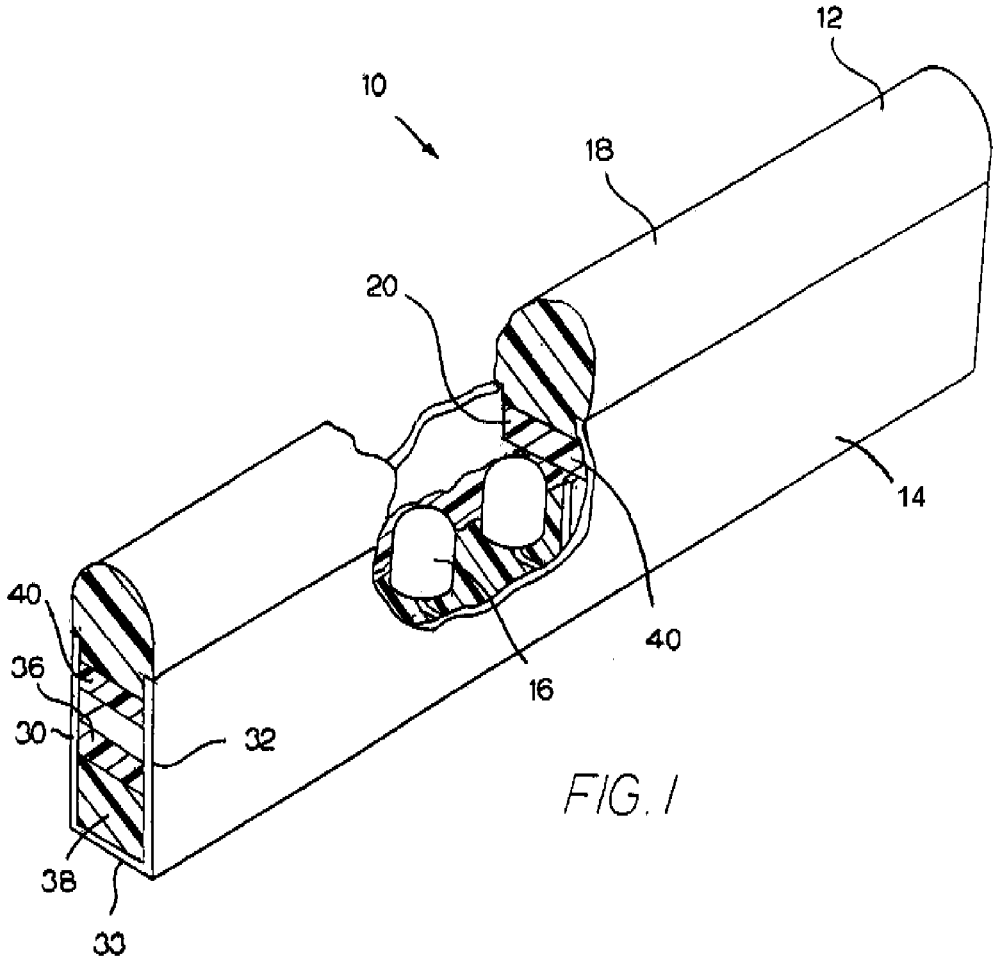
FIG. 1 is perspective view of an illumination device made in accordance with the present invention and including one color conversion module.
Figure 2:
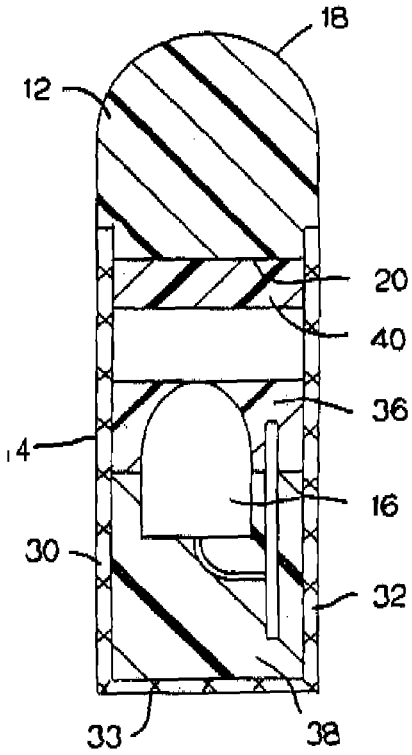
FIG. 2 is a sectional view of the illumination device of FIG. 1.

Referring first to FIGS. 1 and 2, it can be seen that the general structure of the illumination device is similar to that described in U.S. Pat. No. 6,592,238 and U.S. patent application Ser. No. 10/455,639. Specifically, an exemplary illumination device 10 made in accordance with the present invention is generally comprised of a rod-like member 12, a housing 14, and a light source 16. In this exemplary embodiment, the rod-like member is a waveguide 12 that has an external curved lateral surface 18 serving as a light-emitting surface and an interior lateral surface 20 that serves as a light-receiving surface. Light entering the waveguide 12 from the light source 16 positioned below the light-receiving surface 20 is scattered within the waveguide 12 so as to exit with diffused distribution out of the curved lateral surface 18.

Although such a waveguide 12 is known to be a particularly effective at ensuring that the collective light intensity pattern is perceived as being uniform over the entire light-emitting surface, it is contemplated that other forms of diffusing members could also be employed to achieve the desired diffusion and scattering of the light passing through the light conversion module without departing from the spirit and scope of the present invention. For example, various translucent plastics are known to have light-scattering properties.

In any event, returning to the exemplary embodiment of FIGS. 1 and 2, the housing 14 preferably comprises a pair of side walls 30, 32 and a bottom wall 33 that collectively define an open-ended channel that extends substantially the length of the waveguide 12. The housing 14 generally functions to house the light source 16 and associated electrical accessories (e.g., a circuit board), and also may serve to collect and reflect light.

Although it is contemplated that various types of light sources could be incorporated into the illumination device of the present invention, applicant has determined that the best available light source for the purposes of this invention is a string or strings of contiguously mounted high-intensity light-emitting diodes (LEDs).

In this exemplary embodiment, and as best illustrated in FIG. 2, the channel 34 defined by the housing 14 is partially filled with a white potting compound 38 below the light source 16 to reflect light upwardly toward the waveguide 12. Although not shown in the accompanying Figures, such reflection could alternatively be provided by providing the bottom wall 33 of the housing with a reflective coating. Furthermore, in this exemplary embodiment, a portion of the volume of the open-ended channel is also filled with a translucent potting compound 36 that partially encapsulates the light source 16 and maintains the position of the light source 16 relative to the housing 14. When such a translucent potting compound 36 is incorporated into an illumination device 10 constructed in accordance with the present invention, the potting compound 36 should have an index of refraction essentially matching the index of refraction of the light source 16 to minimize Fresnel losses at the interface.

Returning to the use of LEDs as the preferred light source 16, as mentioned above, the available visible color spectrum of an illumination device 10 incorporating LEDs as the light source 16 is limited by the finite availability of LED colors. Furthermore, certain LED colors are significantly more expensive than others and/or have life spans that are significantly shorter than others. Thus, the illumination device 10 of the present invention is constructed so as to provide for emission of light with a perceived color (or hue) that is different than that of the LED itself.

As described in U.S. patent application Ser. No. 10/455,639, this is accomplished through the incorporation of a light color conversion system into the illumination device 10, extending along and positioned adjacent the light source 16 with a light-receiving surface for receiving light emitted from said light source 16 and a light-emitting surface for emitting light into the waveguide 12. As best illustrated in FIG. 2, in accordance with the teachings of the present invention, the light color conversion system is comprised of one or more removable and interchangeable color conversion modules 40 positioned within the open-ended channel defined by the housing 14 and interposed between the light source 16 and the waveguide 12.

Each color conversion module 40 is preferably composed of a substantially translucent polyurethane, acrylic, or similar material tinted with a predetermined combination of one or more fluorescent dyes, phosphorescent dyes, and/or other dyes or colorants. Although a color conversion module 40 can be configured in various geometries, it must have a shape that allows it to be inserted into the channel defined by the housing 14 between the waveguide 12 and the light source 16. Thus, as described in U.S. patent application Ser. No. 10/455,639, because of its position adjacent the light source 16, light emitted from the light source 16 is directed into the one or more color conversion modules 40 and interacts with the fluorescent dyes contained therein. This light is partially absorbed by each of the fluorescent dyes of the color conversion modules 40, and a lower-energy light is then emitted from each of the fluorescent dyes and into the light-receiving surface 20 of the waveguide 12. Furthermore, as noted above, for purposes of the present invention, the color conversion module 40 need not include fluorescent dyes, but phosphorescent dyes and/or other dyes or colorants can also be used without departing from the spirit and scope of the present invention. In any event, the result is that light emitted from the illumination device 10 has a perceived color (or hue) that is different than that of the light source 16.

As described in U.S. patent application Ser. No. 10/455,639, a light color conversion system can be comprised of multiple discrete layers, and each of the individual layers could be tinted with a single dye, but once stacked, the layers work together to achieve the desired result-emission of light of a perceived color different than that of the light source 16. The color conversion modules 40 incorporated into the illumination device of the present invention work in the same manner. Furthermore, the color conversion modules 40 are preferably removable and interchangeable so that various colors can be generated.

Figure 3:
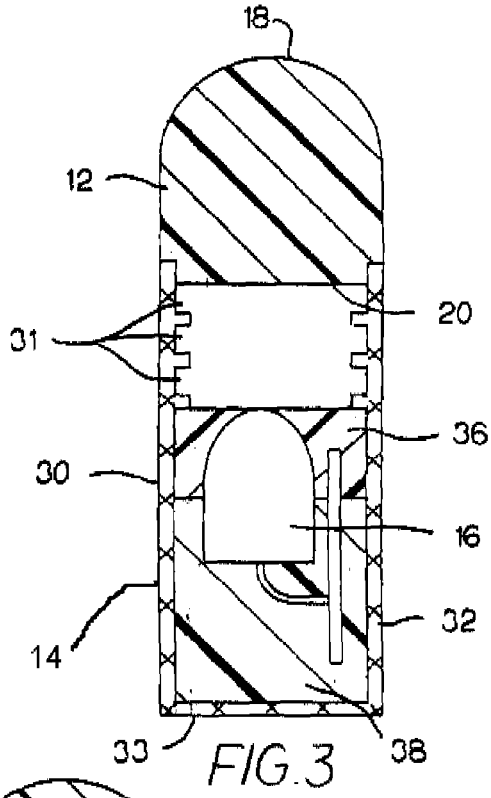
FIG. 3 is a sectional view of an illumination device made in accordance with the present invention in which there are integral slots for receiving and retaining multiple color conversion modules.

To facilitate the interchangeability of the color conversion modules 40, as illustrated in FIG. 3, it is contemplated that the side walls 30, 32 of the housing 14 could be provided with integral slots, generally indicated by reference numeral 31, such that the color conversion modules 40 could be inserted into the slots 31 through an open end of the illumination device 10. In this particular example, there are three slots 31, allowing the illumination device 10 to accommodate up to three separate color conversion modules. Of course, various other means of retaining the color conversion modules 40 within the channel 34 could be used without departing from the spirit and scope of the present invention.

With respect to the embodiments illustrated in FIGS. 1–3, it is also noteworthy that the vertical position of the color conversion modules 40 with respect to the light source 16 does have some impact on the perceived color. Therefore, the perceived color may vary to some extent depending on which slot the color conversion module 40 is placed in.

Figure 3A:
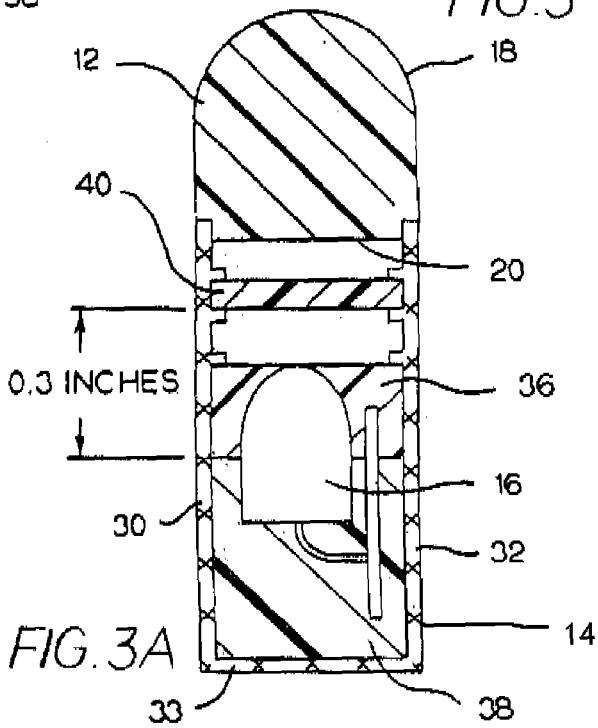
FIG. 3A is a sectional view similar to FIG. 3, in which a color conversion module is retained in one of the integral slots.

Furthermore, with respect to the embodiments illustrated in FIGS. 1–3, it may be advisable to have at least some space remaining between the one or more color conversion modules 40 and the light source 16 such that the color conversion modules 40 not directly contact the light source 16. By leaving some space, there is a better distribution of light from the light source 16 over the lowermost color conversion module 40. For example and as illustrated in FIG. 3A, through experimentation, applicant suggests an approximately 0.30-inch spacing between the lowermost color conversion module 40 and the light source 16 (measured from the centerline of the LED).

Figure 7:
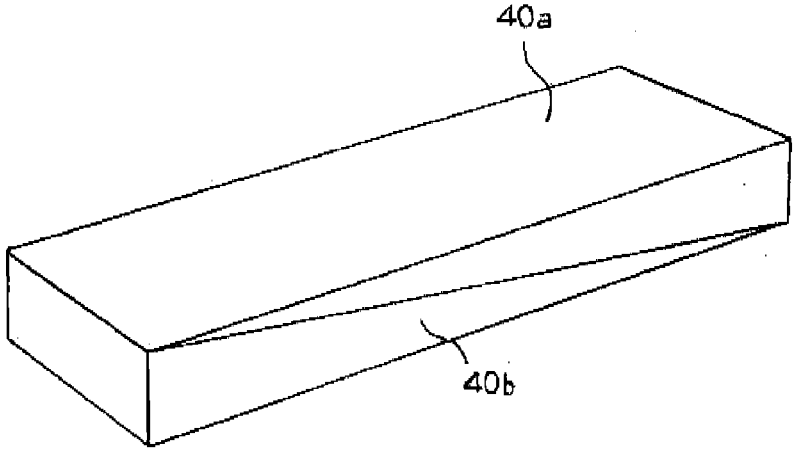
FIG. 7 is a perspective view of a color conversion module comprised of a pair of wedges that are placed adjacent one another to form a substantially rectangular unit.

Also, in the above-described embodiments, the color conversion modules 40 have a generally rectangular shape. However, other shapes are possible without departing from the spirit and scope of the present invention. For example, and as illustrated in FIG. 7, the color conversion modules 40 may be a pair of wedges 40*a*, 40*b* that are placed adjacent one another to form a substantially rectangular unit that can be inserted into the channel together and results in a gradually changing perceived color along the light-emitting surface 18 of the waveguide 12.

Figure 4:
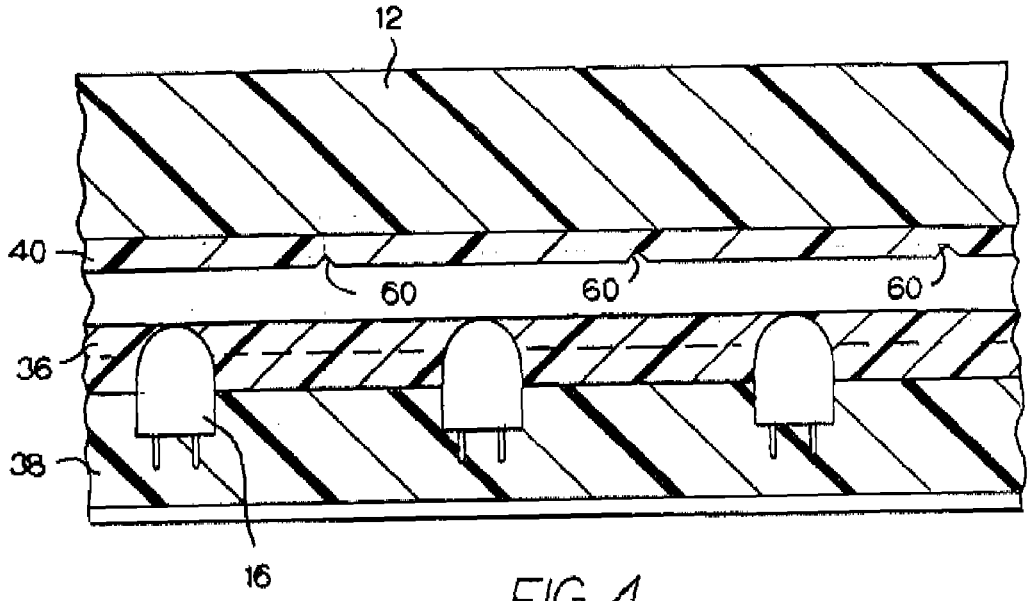
FIG. 4 is a longitudinal sectional view of an illumination device made in accordance with the present invention in which there are notches at spaced intervals along the bottom surface of the color conversion module.
Figure 5:
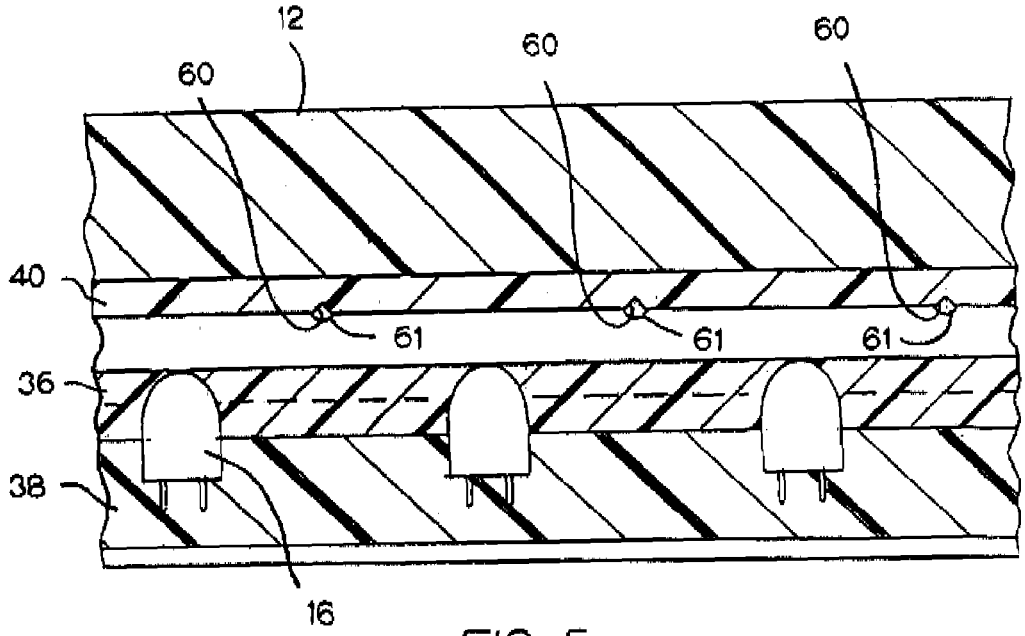
FIG. 5 is a longitudinal sectional view of an illumination device made in accordance with the present invention in which there are notches at spaced intervals along the bottom surface of the color conversion module, each such notch being filled with a reflective material.
Figure 6:
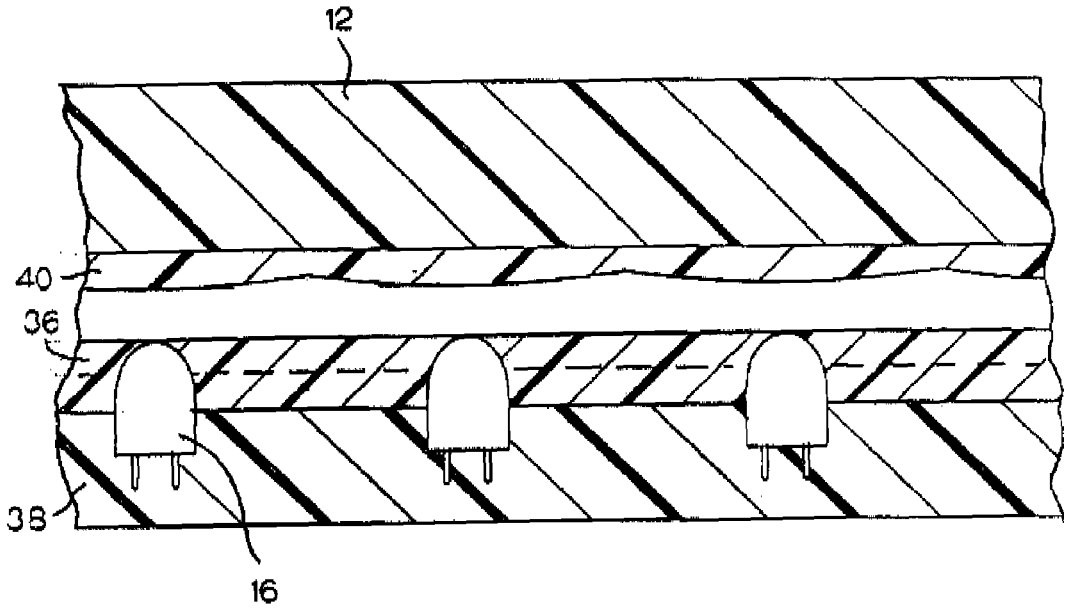
FIG. 6 is a longitudinal sectional view of an illumination device made in accordance with the present invention in which the color conversion module has an undulating bottom surface.

Finally, when constructing an illumination device 10 with color conversion modules 40 as described above, it has been observed that some light is directed along the length of the color conversion modules 40 and is therefore wasted in that it does not exit out the light-emitting surface 18 of the waveguide 12. FIGS. 4–6 illustrate various physical modifications to the surface of a color conversion module 40 in order to ensure that more light is directed through the color conversion modules 40 to the waveguide 12.

In FIG. 4, which is a longitudinal sectional view of an illumination device made in accordance with the present invention, notches 60 are located at spaced intervals and positioned intermediate adjacent LEDs 16 to re-direct light traveling along the length of the color conversion module 40 out toward the waveguide 12. In FIG. 5, there are also notches 60 at spaced intervals, but these notches 60 are filled with a reflective material 61. In FIG. 6, the color conversion module 40 has an undulating bottom surface, with the peaks corresponding to individual LEDs.

One of ordinary skill in the art will also recognize that additional embodiments are possible without departing from the teachings of the present invention or the scope of the claims which follow. This detailed description, and particularly the specific details of the exemplary embodiments disclosed therein, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. An illumination device, comprising:

a light source emitting light of a predetermined first hue;

a diffusing member positioned adjacent said light source;

one or more removable and interchangeable color conversion modules that are selectively interposed between said light source and said diffusing member, each color conversion module including one or more dyes, each said color conversion module receiving light emitted from said light source and emitting light of a second hue into said diffusing member; and a housing including a pair of side walls and a bottom wall that collectively define an open-ended channel that extends along the length of the diffusing member for housing the light source and associated electrical accessories, with said one or more removable and interchangeable color conversion modules also being received and retained in the housing between said light source and said diffusing member.

2. The illumination device as recited in claim 1, in which said diffusing member is a substantially rod-like member having a predetermined length, said rod-like member being composed of a material that has both optical waveguide and light scattering properties so as to preferentially scatter light along the length of said rod-like member.

3. The illumination device as recited in claim 2, in which said rod-like member is a waveguide that has an external curved lateral surface serving as a light-emitting surface and an interior surface that serves as a light-receiving surface, with light entering the waveguide from the one or more removable and interchangeable color conversion modules positioned below the light-receiving surface being scattered within the waveguide so as to exit with diffused distribution out of the curved lateral surface.

4. The illumination device as recited in claim 1, in which said dyes are fluorescent dyes.

5. The illumination device as recited in claim 1, in which said dyes are phosphorescent dyes.

6. The illumination device as recited in claim 1, in which said light source is a plurality of light-emitting diodes.

7. The illumination device as recited in claim 6, in which notches are provided at spaced intervals along a lower surface of at least one of said color conversion modules to re-direct light traveling along the length of said one color conversion module out toward the diffusing member.

8. The illumination device as recited in claim 7, wherein said notches are positioned intermediate adjacent light-emitting diodes.

9. The illumination device as recited in claim 6, in which at least one of said color conversion modules has an undulating lower surface with peaks corresponding to individual light-emitting diodes.

10. The illumination device as recited in claim 7, wherein said notches are filled with a reflective material.

11. The illumination device as recited in claim 1, in which the open-ended channel is partially filled with a white potting compound substantially below the light source to reflect light upwardly toward the diffusing member.

12. The illumination device as recited in claim 11, in which a portion of the volume of the open-ended channel is also filled with a translucent potting compound that partially encapsulates the light source and maintains the position of the light source relative to the housing.

13. The illumination device as recited in claim 1, in which the side walls of said housing are provided with integral slots, such that said one or more color conversion modules are inserted into the slots through an open end of the illumination device.

14. An illumination device, comprising:

a light source emitting light of a predetermined first hue;

a diffusing member having a predetermined length and positioned adjacent said light source;

a housing including a pair of side walls and a bottom wall that collectively define an open-ended channel that extends substantially the length of the diffusing member for housing the light source and associated electrical accessories; and one or more removable and interchangeable color conversion modules that are selectively interposed between said light source and said diffusing member within said housing, each color conversion module including one or more dyes, each said color conversion module receiving light emitted from said light source and emitting light of a second hue into said diffusing member;

wherein the side walls of said housing are provided with integral slots, such said one or more color conversion modules are inserted into the slots through an open end of the illumination device.

15. The illumination device as recited in claim 14, in which said diffusing member is a substantially rod-like member, said rod-like member being composed of a material that has both optical waveguide and light scattering properties so as to preferentially scatter light along the length of said rod-like member.

16. The illumination device as recited in claim 15, in which said rod-like member is a waveguide that has an external curved lateral surface serving as a light-emitting surface and an interior surface that serves as a light-receiving surface, with light entering the waveguide from the one or more removable and interchangeable color conversion modules positioned below the light-receiving surface being scattered within the waveguide so as to exit with diffused distribution out of the curved lateral surface.

17. The illumination device as recited in claim 14, in which said dyes are fluorescent dyes, phosphorescent dyes, or a combination thereof.

18. An illumination device, comprising:

a light source emitting light of a predetermined first hue;

a diffusing and substantially rod-like member positioned adjacent said light source, said rod-like member having a predetermined length and being composed of a material that has both optical waveguide and light scattering properties so as to preferentially scatter light along the length of said rod-like member, said rod-like member further having an external curved lateral surface serving as a light-emitting surface and an interior surface that serves as a light-receiving surface; and one or more removable and interchangeable color conversion modules that are selectively interposed between said light source and said diffusing and substantially rod-like member, each said color conversion module including one or more dyes, each said color conversion module receiving light emitted from said light source and emitting light of a second hue into said diffusing and substantially rod-like member, with light entering the rod-like member from the one or more removable and interchangeable color conversion modules being scattered within the rod-like member so as to exit with diffused distribution out of the curved lateral surface.

19. An illumination device, comprising:

a light source emitting light of a predetermined first hue;

a diffusing member having a predetermined length and positioned adjacent said light source;

a housing including a pair of side walls and a bottom wall that collectively define an open-ended channel that extends substantially the length of the diffusing member for housing the light source and associated electrical accessories, the side walls including integral slots, such said one or more color conversion modules are inserted into the slots through an open end of the illumination device; and one or more removable and interchangeable color conversion modules that are selectively interposed between said light source and said diffusing member within said housing, each said color conversion module including one or more dyes, each said color conversion module receiving light emitted from said light source and emitting light of a second hue into said diffusing member.

* * * * *